US008033231B2

(12) United States Patent
DeFranks et al.

(10) Patent No.: US 8,033,231 B2
(45) Date of Patent: Oct. 11, 2011

(54) PANEL QUILT MACHINE WITH FEEDER PROVIDING REDUCED DOWNTIME

(75) Inventors: Michael S. DeFranks, Decatur, GA (US); Michael A. Dimarco, Atlanta, GA (US); James R. Peavyhouse, Lilburn, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 647 days.

(21) Appl. No.: 12/009,878

(22) Filed: Jan. 22, 2008

(65) Prior Publication Data

US 2009/0183662 A1 Jul. 23, 2009

(51) Int. Cl.
*D05B 11/00* (2006.01)
*D05B 33/00* (2006.01)

(52) U.S. Cl. ..... 112/117

(58) Field of Classification Search ..... 112/117–119, 112/303–307, 314
See application file for complete search history.

(56) References Cited

U.S. PATENT DOCUMENTS

| | | | | |
|---|---|---|---|---|
| 2,940,404 | A * | 6/1960 | Damon | 112/470.07 |
| 3,960,095 | A * | 6/1976 | Story | 112/118 |
| 4,501,208 | A * | 2/1985 | Landoni | 112/118 |
| 4,651,658 | A * | 3/1987 | Vogel | 112/118 |
| 5,603,270 | A * | 2/1997 | White et al. | 112/117 |
| 5,617,802 | A * | 4/1997 | Cash | 112/117 |
| 5,913,277 | A * | 6/1999 | Resta | 112/470.12 |
| 5,974,994 | A * | 11/1999 | Stutznacker et al. | 112/118 |
| 6,237,517 | B1 * | 5/2001 | Bondanza et al. | 112/118 |
| 6,293,213 | B1 * | 9/2001 | Block et al. | 112/470.05 |
| 6,786,164 | B2 * | 9/2004 | Myers et al. | 112/475.08 |
| 2003/0136319 | A1 | 7/2003 | Myers et al. | |

FOREIGN PATENT DOCUMENTS

| | | | |
|---|---|---|---|
| BE | 674 714 | A | 5/1966 |
| CH | 691 390 | A5 | 7/2001 |
| DE | 10 2005 018722 | B3 | 6/2006 |
| WO | WO-96/36760 | A | 11/1996 |
| WO | WO-01/07699 | A | 2/2001 |

OTHER PUBLICATIONS

International Search Report for PCT/US2009/000416 dated May 27, 2009.

* cited by examiner

*Primary Examiner* — Ismael Izaguirre
(74) *Attorney, Agent, or Firm* — Cantor Colburn LLP

(57) ABSTRACT

Panel quilting machines having an in-line splicing tool capable of splicing a new supply of fabric into a web of material being provided to a panel quilting machine while allowing for continuous operation of the panel quilting machine. The systems and methods described herein include, in certain embodiments, an in-line accumulator for creating a temporary in-line supply of material for use by the panel quilting machine while an exhausted supply of material is replaced with a new supply of material.

22 Claims, 5 Drawing Sheets

PANEL QUILT MACHINE WITH FEEDER PROVIDING REDUCED DOWNTIME

BACKGROUND OF THE INVENTION

Mattresses typically have quilted panels that are attached to the mattress core to provide the mattress' exterior surfaces, including the upper sleeping surface. During manufacture of the mattress, these quilted panels are produced by panel quilting machines that draw in multiple webs of material including ticking material and foam padding, and quilt the different webs together to form a panel that can be secured to the mattress core.

For the quilt panel machines to work effectively, they need a ready supply of material that can be drawn into the machine as it creates the quilted panel. Typically the material is provided as rolls of fabric or foam, or it may be fan folded and placed in a hamper. Either way, the quilt panel machine will continuously draw the fabric off the roll or out of the hamper as it quilts the panels.

At one point however, the supply of material will need to replaced. This may be because the original roll becomes depleted, or the kinds or colors of the fabric or foam being quilted need to be altered. At that point the panel quilting machine must be stopped to allow the operator to switch out the old supply of material and add in a new supply. In actual practice, the panel quilting machine is stopped quite often thereby causing a substantial amount of downtime for the machine. One study shows that during a typical day of operation, the quilt panel machine is inactive for up to 75% of the time. Much of this downtime arises from the need to change the supply of material.

Changing the supply of material may be time consuming as it requires the operator to remove the old supply, gather the new supply, splice the new supply into the web of material being drawn into the panel quilt machine, and restart operation. Given this, the machine is not being used to its full potential and capital costs are incurred to address this inefficiency.

Accordingly, there is a need for improved systems and methods for providing fabric and materials to a panel quilting machine.

SUMMARY OF THE INVENTION

The systems and methods described herein include, inter alia, panel quilting machines having an in-line splicing tool capable of splicing a new supply of fabric into a web of material being provided to a panel quilting machine while allowing for continuous operation of the panel quilting machine. The systems and methods described herein include in certain embodiments an in-line accumulator for creating a temporary in-line source of material to source to the panel quilting machine while the old supply of material is replaced with a new supply of material.

More particularly, the systems and methods described herein include, among other things, a quilting station that has a quilting machine with a feeder for drawing material into the machine, and a material dispensing unit having an active dispenser and a reserve dispenser. The quilting station includes a plurality of rollers that define a path for a web of material to pass from the active dispenser to the quilting machine. A path extender is disposed within the defined path and has a moveable surface for contacting the web of material passing along the defined path and for redirecting the web along an extended path to thereby create an in-path supply of material. A joiner joins material from the reserve dispenser to the web of material passing along the defined path, and a cutter, optionally located adjacent the joiner, cuts the material from the active dispenser away from the web passing along the defined path.

Optionally, the quilting station may also have a controller for controlling the movement of the web of material. The controller may be programmed to control the path extender to create the in-path supply of material at a time selected to allow for continuous, or nearly continuous, operation of the quilting machine. The controller may be controlled by an operator or a batch processing program.

In a further optional embodiment, the quilting machine may include a brake that is placed within the defined path and secures the web to prevent movement or motion of the web. The brake may be a clamp and/or ratchet disposed within the defined path for preventing movement of the web in a particular direction.

The joiner may be a bag sewer, glue machine, stapler, thermal or ultrasound welder or other device suitable for joining materials, typically fabric or foam materials, together.

The quilting machine may have a supply table that has an active dispenser and a reserve dispenser formed into the supply table. In one embodiment, the active dispenser is a curved surface that forms a cradle for a roll of material. There can be an optional set of rollers placed into the cradle for supporting the roll of material to allow material to more easily unroll as the web passes along the path. The reserve dispenser may, in one embodiment, be a flat surface on the table that has a set of rollers for supporting the reserve roll of material to allow material to unroll as it is pulled across the path and into the quilting machine.

The path extender may include a roller mounted on a moveable arm and disposed within the defined path. The arm may be motorized so that it can move the roller from a first position to a second different position. This extends the path of the web and creates a supply of material that can be used to provide for continuous or near continuous operation of the quilting machine.

Alternatively, the path extender may include a weighted roller placed within the defined path, and a releasable latch for releasing the weighted roller to apply a force to the web of material for extending the defined path. Still other embodiments and variations may exist for the path extender, and all such alternatives are deemed within the scope of the invention.

In another aspect, the systems and methods described herein include a material dispensing unit that comprises an active dispenser and a reserve dispenser for providing material to a web of material moving along a defined path. The system has a plurality of rollers that define the path for the web of material that is being supplied from either the active dispenser or the reserve dispenser and to the quilting machine. A path extender is positioned within the web's path and has a moveable surface for contacting the web as it passes along the defined path and for redirecting the web along an extended path. This, in part, creates an in-path supply of material. A joiner joins material from the reserve dispenser to the web of material passing along the defined path, and a cutter cuts material from the active dispenser away from the web passing along the defined path.

BRIEF DESCRIPTION OF THE DRAWINGS

The foregoing and other objects and advantages of the invention will be appreciated more fully from the following further description thereof, with reference to the accompanying drawings wherein.

DETAILED DESCRIPTION OF THE ILLUSTRATIVE EMBODIMENTS

To provide an overall understanding of the invention, certain illustrative practices and embodiments will now be described, including a method for manufacturing a quilted panel for a mattress. However, it will be understood by one of ordinary skill in the art that the systems and methods described herein can be adapted and modified and applied in other applications and that such other additions, modifications and uses will not depart from the scope hereof.

The systems and methods described herein include panel quilting machines and systems for feeding material into panel quilting machines. In particular, the systems and methods described herein include material handling systems that are capable of rapidly splicing a new supply of material onto a web of material being drawn into a panel quilting machine. As described herein, the systems and methods of the invention may employ an in-line accumulator for accumulating a temporary reserve of material that can be drawn into the panel quilting machine at the time that an exhausted or no longer needed supply of material is substituted with a new or desired supply of material.

Figure 1:
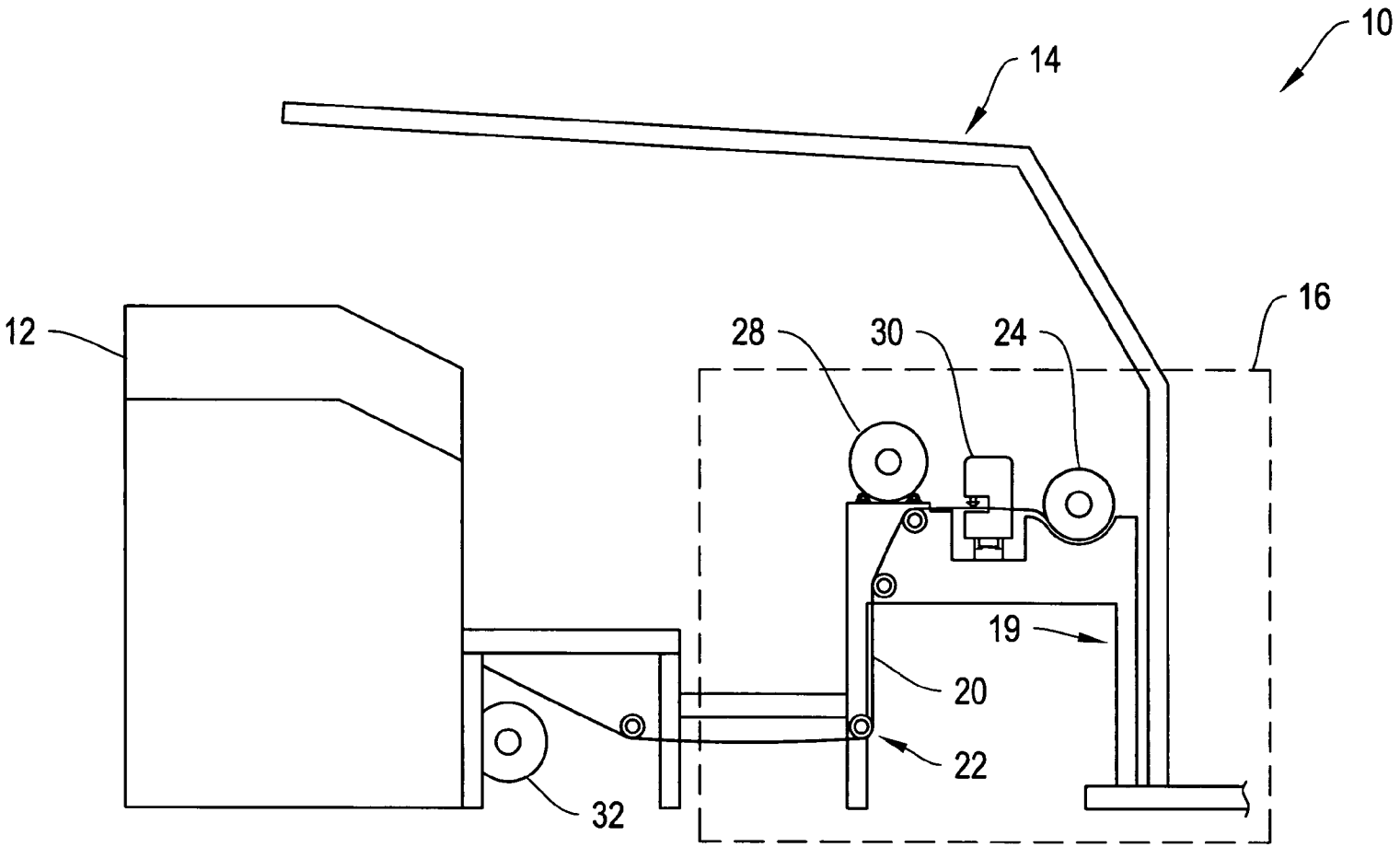
FIG. 1 depicts one embodiment of a system according to the invention.

FIG. 1 depicts a first embodiment of the systems and methods described herein. In particular, FIG. 1 depicts a panel quilting system 10 that includes a panel quilting machine 12, a conventional thread rack 14 and a material feeding system 16 that is made up of the several cooperating components depicted within the box of dashed lines. The quilting machine 12 draws material from a roll of material 24 and pulls thread in from the thread rack 14 and forms quilted panels by essentially sewing together different webs of material drawn into the quilting machine 12, forming designs and patterns as the materials are joined. The material feeding system 16 provides a continuous supply of material to the quilting machine 12, thereby reducing the amount of time the quilting machine is down due to material supply changeover. In the embodiment depicted in FIG. 1, the illustrated material feeding supply 16 includes a support table 19 that holds a current roll of material 24, a reserve roll of material 28, a splicing tool 30 and a set of rollers 22. The material feeding system 16 feeds a web 20 of material from the current roll 24 along a path defined by a plurality of rollers 22. The web 20 travels across the defined path and into the quilting machine 12. In the depicted embodiment a roll 32 of another type of material, which may for example be backing material, provides a second independent web of material being drawn into the quilting machine 12. This backing material 32 and other webs of material may be fed into the quilting machine 12 to be stitched together into a panel that can be used for a mattress.

The material feeding system 16 depicted in FIG. 1 allows the current roll 24 of material to be replaced with the reserve roll of material 28 pausing the quilting machine 12 for only a small fraction of the total run time. To this end, the material feeding machine 16 includes the table 19 that supports the current in-use roll of material 24 and a reserve roll of material 28. In the depicted embodiment the current roll 24 sits in a trough defined within the table 19. The defined trough provides a curved seat into which the current roll of material 24 can sit and rotate while material is unwound from the roll 24 and fed as the web 20 that travels along the defined path and into the quilting machine 12. A splicing tool 30 is carried on the table 19 and sits between the current roll 24 and a reserve roll 28. In one practice, as the supply of material on the current roll 24 is drawn down, an operator can get ready to use the splicing tool 30 to splice material from the reserve roll 28 onto the web 20 being pulled into the quilting machine 12. In practice, the operator will move the splicer 30 across the width of the web 20 to splice material from the reserve roll 28 onto the web 20 and cut the material from the old roll 24 away from the web 20, thereby joining the reserve roll 28 to the web 20. In certain embodiments, the quilting machine 12 is paused during splicing and resume after the material from the reserve roll 28 is spliced onto the web 20. At that time, the operator can move the current roll 24 from the trough and place the reserve roll 28 into the trough so that the reserve roll 28 acts as the current roll 24, and rotates as material is pulled from the roll 28. Once the roll 28 is in place, the operator can select a new reserve roll from storage and place it on the table 19 at the position where the reserve roll 28 had earlier been.

The panel quilting machine 12 depicted in FIG. 1 includes a motor assembly that will draw in the supply of material as the web 20. Optionally, the quilting machine 12 can have a controller that controls the rate at which the web 20 is drawn into, and in some cases sent back towards, the supply system 16. The controller may also have a processing unit that determines how much material may be drawn off a roll before it is time for the current roll to be replaced with a new roll. At that time the quilting machine 12 can indicate to an operator that it is time to replace the current roll. To this end the quilting machine 12 may include a set of indicator lights, a siren, or some other mechanism that warns the operator that it is time to, or soon will be time to, replace the current roll of material. For example, in certain embodiments and practices, the controller may activate an indicator light about three minutes before the controller calculates the current roll will become depleted. In alternative embodiments, the operator monitors the roll 24 and decides when to replace the current roll 24 with a new roll 28. In certain embodiments the quilting machine 12 and the supply system 16 are integrated together as a single unit, however in other more common embodiments the quilting machine 12 is a separate quilting machine and the supply system 16 is a separate unit that can be positioned in front of the quilting machine 12 to produce the system 10 depicted in FIG. 1.

Figure 2B:
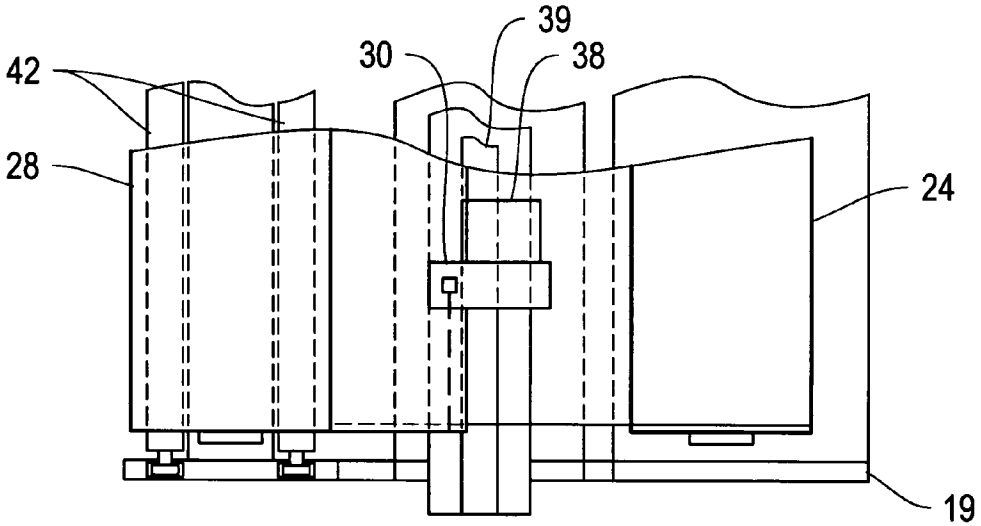
FIGS. 2A and 2B depict a splicer of the type suitable for use with the system depicted in FIG. 1 and depict the splicer in operation for splicing a new cover roll onto a moving web drawn from the currently used cover roll.
Figure 2A:
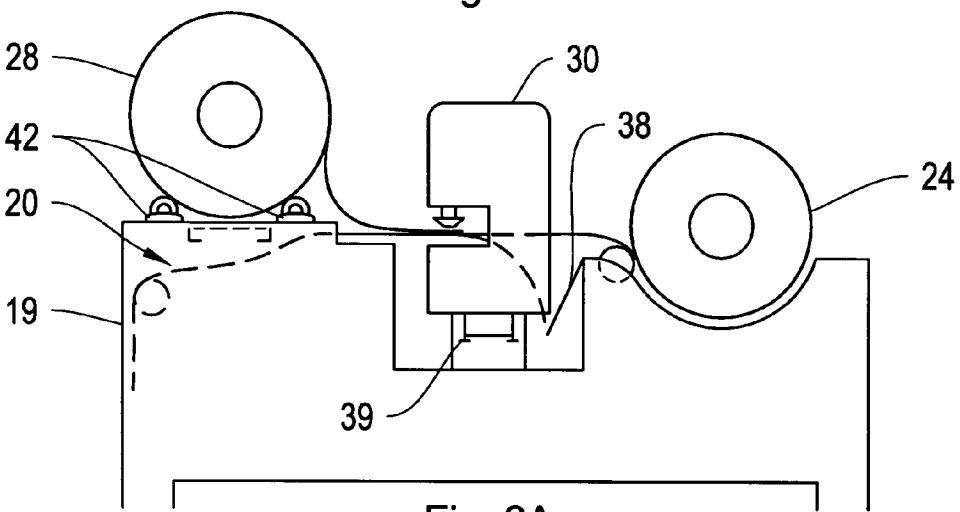

Turning to FIGS. 2A and 2B the operation of the splicing unit 30 is depicted in more detail. In particular, FIG. 2A shows the splicing table 19 as well as the splicing unit 30 that is positioned between the two rolls of material 24 and 28. In particular, FIG. 2A illustrates that the roll 24 sits in the trough formed in table 19 and material is pulled or unrolled from the roll 24 so that it travels along as the web 20 following the path defined by the rollers 22. At one point the operator of the quilting machine 12 determines that it is time to replace the roll 24 with the new roll 28. At that time as shown in FIG. 2A material from the new roll 28 can be laid over the web of material 20 traveling along the rollers 42. The splicing unit 30 is capable of joining the new roll of material to include in this embodiment a bag sewer that is movable along a track 39 so that it travels along the full width of the web 20 and a cutter 38 that in this embodiment is integrally formed with the bag sewer. The cutter 38 may be a blade that connects to the bag sewer and is positioned and oriented, as shown in FIG. 2A, to cut through the web as the splicing unit 30 moves across the width of the web 20. At the same time that the cutter 38 moves across the width of the web 20, the bag sewer also moves along the width of the web 20 and it joins material from the new roll 28 to the web 20. The depicted bag sewer works by sewing material from the new roll 28 to the web 20, but in other embodiments, the splicing unit 30 may use an alternate device for joining material from the new roll 28 to the web 20, including gluing, ultrasonic welding, stapling, or some other means of fastening. In any case, once the new roll is joined to the web 20, the cutter 38 cuts away material from the old roll 24 so that the roll 24 is no longer joined to the web 20. In the depicted embodiment the cutter 28 is shown as a blade extending upward and into the path of the web 20. However, in other embodiments, the cutter may be a rotating blade, a moving pair of scissors, a thermal cutting element or any other suitable structure for separating the roll of material from the web 20. In the embodiment depicted in FIG. 2A, the new roll 28 sits on a pair of rollers 42 so that as the web 20 is drawn into the quilting machine 12, the roll 28 can spin on the rollers 42 so that the material unrolls from the roll 28.

FIG. 2B depicts in more detail the action of the splicing unit 30. In particular, FIG. 2B provides a bird's eye view of the support table 19 on which the new roll 28 and current roll 24 are both seated. FIG. 2B shows the two rolls 24 and 28 as partially cut away with the distal section of the rolls not pictured. FIG. 2B also shows that the roll 28 is placed over two rollers 42, also shown in partial cut away. This bird's eye view show the that splicing unit 30 includes, in this embodiment, a bag sewer, shown as a small box in FIG. 2B, and a cutter 38, depicted as a flat rectangular blade that extends outward from the bag sewer in the direction of the current roll 24. The bag sewer may be any suitable bag sewer and such units are commercially available. The splicing unit 30 when not in use can be stowed away off to the side of the web at the position designated by the letter "A" in FIG. 2A. This keeps the splicing unit 30 out of the path of the web 20, allowing the web to move freely over the table 19 and along the defined path.

In operation, the splicing unit 30 may start from the position A located away from the web 20. The splicing unit 30 is mounted on a rail 39 that the web 20 travels over. The splicing unit 30 slides over the rail 39 to move over the web 20. The operator, as depicted in FIG. 2A, takes material from the new roll 28 and lays it over the web 20 drawn from the current roll 24. The bag sewer then can be moved across the width of the web 20 to join material from the new roll 28 to the web 20. Also shown in FIG. 2B the cutter 38 precedes the bag sewer. The cutter 38 cuts away material from the current roll 24 so that the current roll 24 is detached from the web 20. The splicing unit 30 optionally may function for both directions of travel so that splicing can occur regardless of the direction the splicing unit is moving as it travels over the rail 39. The seam formed by the splicing unit 30 is part of the crop-out region of the web formed after the material has been quilted into a panel by the quilting machine 12. In alternate embodiments the splicing unit 30 may include a glue gun, an ultrasonic welder, a device for applying mechanical staples or fasteners, or some other device for attaching the new supply of material to the web 20.

In one embodiment, the material feeding system 16 allows the quilting machine 12 to keep operating during material change over by creating an in-line supply of material to feed to the quilting machine 16 while the splicing unit is joining the new roll 28 to the web 20. To this end, the quilting machine 12 may include a hamper that can store a fan fold of the web 20. The stored fan fold of web material provides an in-line supply of material that the quilting machine may draw on while the current roll 24 is stopped from rotating and the new roll 28 is joined to the web 20. The hamper in the quilting machine 12 may be a drawer located at the front of the quilting machine 12. The supply of web material maybe placed into the hamper by having the operator manually pull on the web 20 until a supply of web 20 material is accumulated into the hamper. Rather than doing this manually, the quilting machine 12 may be equipped with a motorized web collection device that pulls the web 20 into the hamper at a rate that is greater than the rate at which the quilting machine 12 draws the web 20 from the hamper. In either case, this accelerated collection of web material ensures that the web material is there during those times that the splicing unit 30 is ready to join the new roll 28 of material to the web 20. In certain embodiments, the quilting machine 12 includes one or more powered nip rollers. In such embodiments, the nip may be actuated so that it is held open during normal operation and closed when needed to pull fabric from current roll 24. When extra fabric is needed, the nip may be closed and driven by a motor at a speed faster than the quilting machine 12. In certain embodiments, additional fabric is collected in a fan-folder basket and used as needed by the quilter.

Figure 3:
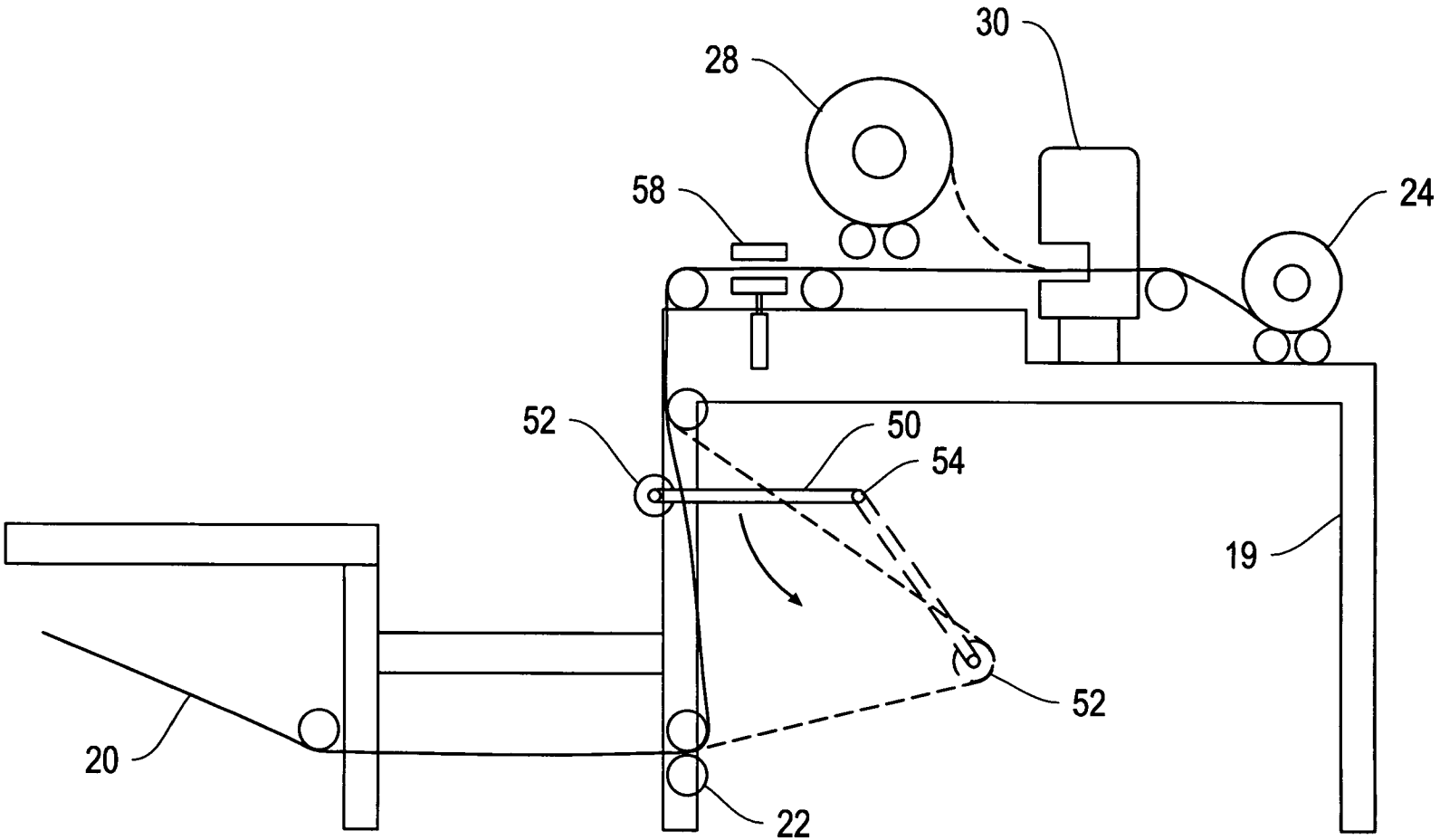
FIG. 3 depicts an embodiment with an in-line web accumulator.

Turning to FIG. 3, an alternate embodiment is depicted wherein underneath the support table 19 is an accumulator arm 50. In this embodiment, the accumulator arm 50 is mounted to an axis 54 about which the accumulator arm 50 can pivot. A roller 52 is positioned on the arm 50. As shown in FIG. 3, the accumulator arm 50 is pivots about the axis 54 such that it can displace the roller 52 away from the quilting machine 12 and to an alternate location as indicated by the dashed line. This pivoting of the accumulator arm 50 extends the defined path that the web 20 travels over so that that path is temporarily lengthened. The accumulator 50 extends the path an amount sufficient to create a reserve supply of material that the quilting machine 12 can draw inward and use during that time that the operator is splicing the new roll of material onto the web 20. In one embodiment the axis 54 may include an electric motor assembly that acts as an actuator for rotating the arm 54 such that it pivots the roller 52 away from the side of the splicing table toward the middle of the splicing table. Once the path has been extended by operation of the accumulator arm 50, the accumulator arm 50 can then return to its initial position, returning it at a pace that is commensurate with the pace at which the quilting machine 12 is drawing fabric inward. This allows the quilting machine 12 to continue operation as it is pulling material from the accumulated section of fabric under the support table 19. As the web 20 is being drawn from the reservoir of material created by the accumulator arm 50, the web 20 is not being pulled from the roll 24 and toward the quilting machine 12. As such the portion of the web between roller 52 and the splicing unit 30 will not move at that time, there by providing a convenient moment for an operator to operate the splicing unit 30 to cut away the web from the currently used roll 24 and sew the material from the new roll 28 onto the web 20.

In the embodiment depicted in FIG. 3 an optional clamp assembly 58 is provided that can clamp onto the web 20. This clamp 58 prevents the pulling force of the quilting machine 12 from pulling material from the roll 24 during those times that the system is trying to feed web 20 to the quilting machine 12 from the accumulated in line supply. An other optional clamp 60 may be provided that prevents the web 20 from moving inwardly toward the support table 19 when the accumulator arm 50 is pulling the roller 52 away from the quilting machine 12 towards the center section of the table 19. A pall or other type of assembly may be used to grip the fabric web 20 in a manner sufficient to prevent it from moving backward towards the splicing system 16 but gently enough so that it does not rip or tear the fabric.

Figure 4:
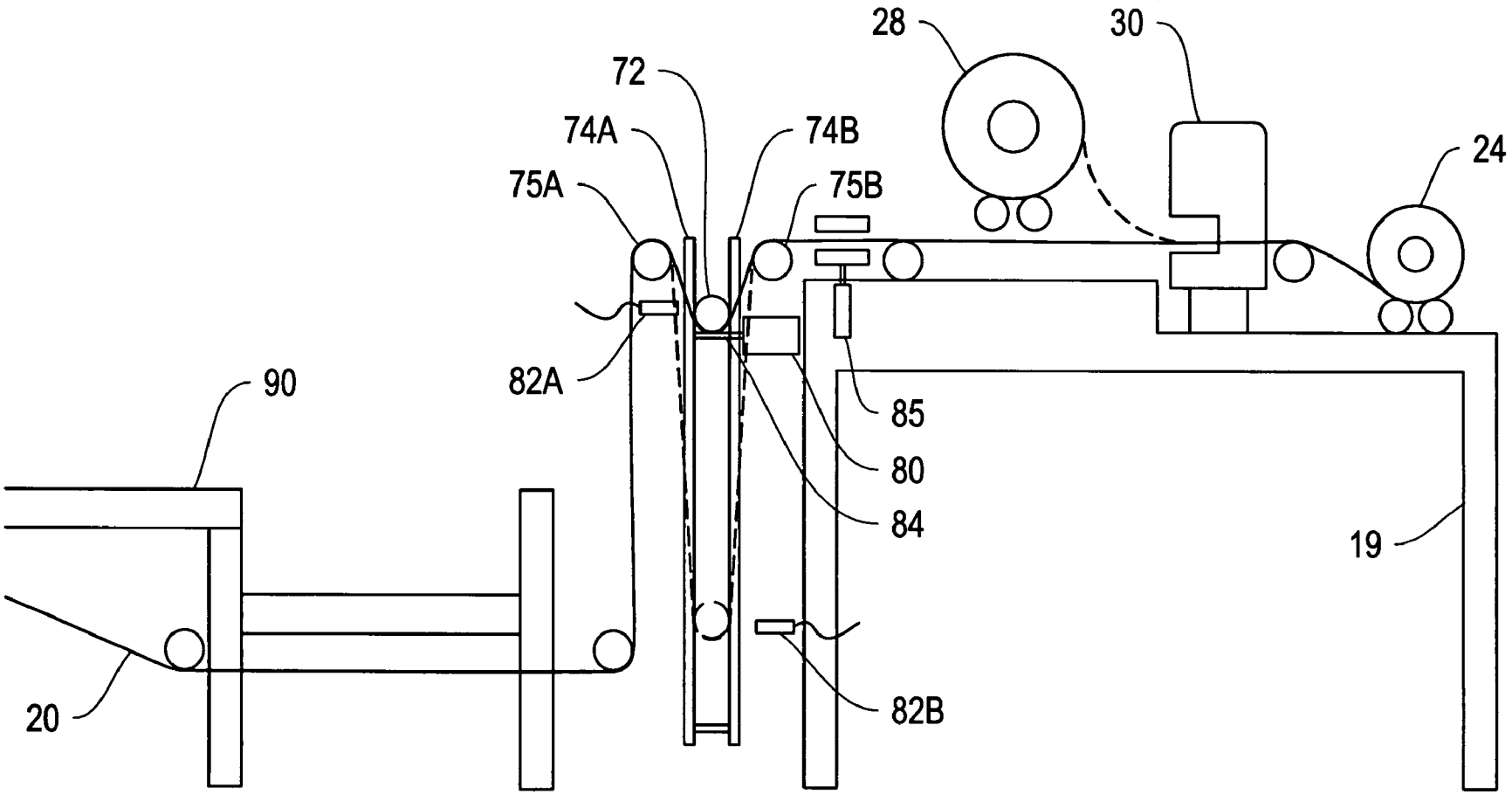
FIG. 4 depicts an alternative embodiment with an accumulator having movable dancer rolls.

FIG. 4 depicts an alternate embodiment of the systems described herein. In particular FIG. 4 depicts a supply system 16 that includes an accumulator that has a moveable dancing roller 72. As shown in FIG. 4 the accumulator is positioned after the support table 19 and before the catwalk 90 of the quilting machine 12. In this embodiment the support table 19 supports a first roll 24 and a second roll 28 of material. The splicing unit 30 fits between the two rolls 24 and 28. Unlike the support table 19 shown in the earlier embodiments, in this embodiment, both rolls 24 and 28 sit on a pair of rollers that can rotate for the purpose of allowing material to be spooled or unwound from the roll. The accumulator includes two guide rails 74A and 74B and the dancer roller 72 sits between the two arms. The web 20 extends from the support table 19 and passes over rollers 75A and 75B. The moveable dancer roller 72 is disposed between the two rollers 75A and 75B and it is positioned so that the web 20 passes under the dancer roller 72. In the depicted embodiment, the dancer roller 72 drops from its first position to its second lower position. However, in other embodiments the dancer roller may be mounted to a pair of motor driven chains that drive the roller up and down between the two positions shown in FIG. 4. Other mechanisms for moving the dancer roller between its upper and lower positions may also be employed without departing from the scope of the invention.

As further shown in FIG. 4 the accumulator includes an actuator element 80 depicted as a piston in FIG. 4. The actuator element 80 is capable of moving a projecting arm 84 from a position that supports the dancer roller 72 to one that releases the dancer roller 72 so that it can fall from a first position to a second lower position depicted by the dotted lines in FIG. 4. A pair of sensors 82A and 82B can detect the relative position of the dancer roller 72 to determine whether it is in the top most or lower most position.

As discussed above with reference to FIG. 3, the accumulator is capable of extending the path the web 20 takes between the support table 19 and the quilt machine 12. By extending the path, the accumulator creates a reserve of material that can be fed to the quilting machine 12 while an operator or an automatic system replaces the roll 24 currently being used with the reserve roll 28. FIG. 4 also depicts an optional clamp 85. When the dancer roller 72 is in the proper position as indicated by the sensor 82B, the clamp 85 will engage. The clamp 85 can prevent movement of the web 20 across the surface of the support table 19 and require that the quilt machine 12 draw in web material from the reserve of material formed by the extended web path that is created when the dancer roller 72 moves from its initial position to the lower position depicted in FIG. 4. During this time the operator can swap out roll 28 for roll 24. If the sensor 82A detects that the dancer roller 72 is in its original position before the operator has completed the splicing operation, the quilting machine 12 may be paused by the controller or operator until the splicing operation has completed.

Figure 5:
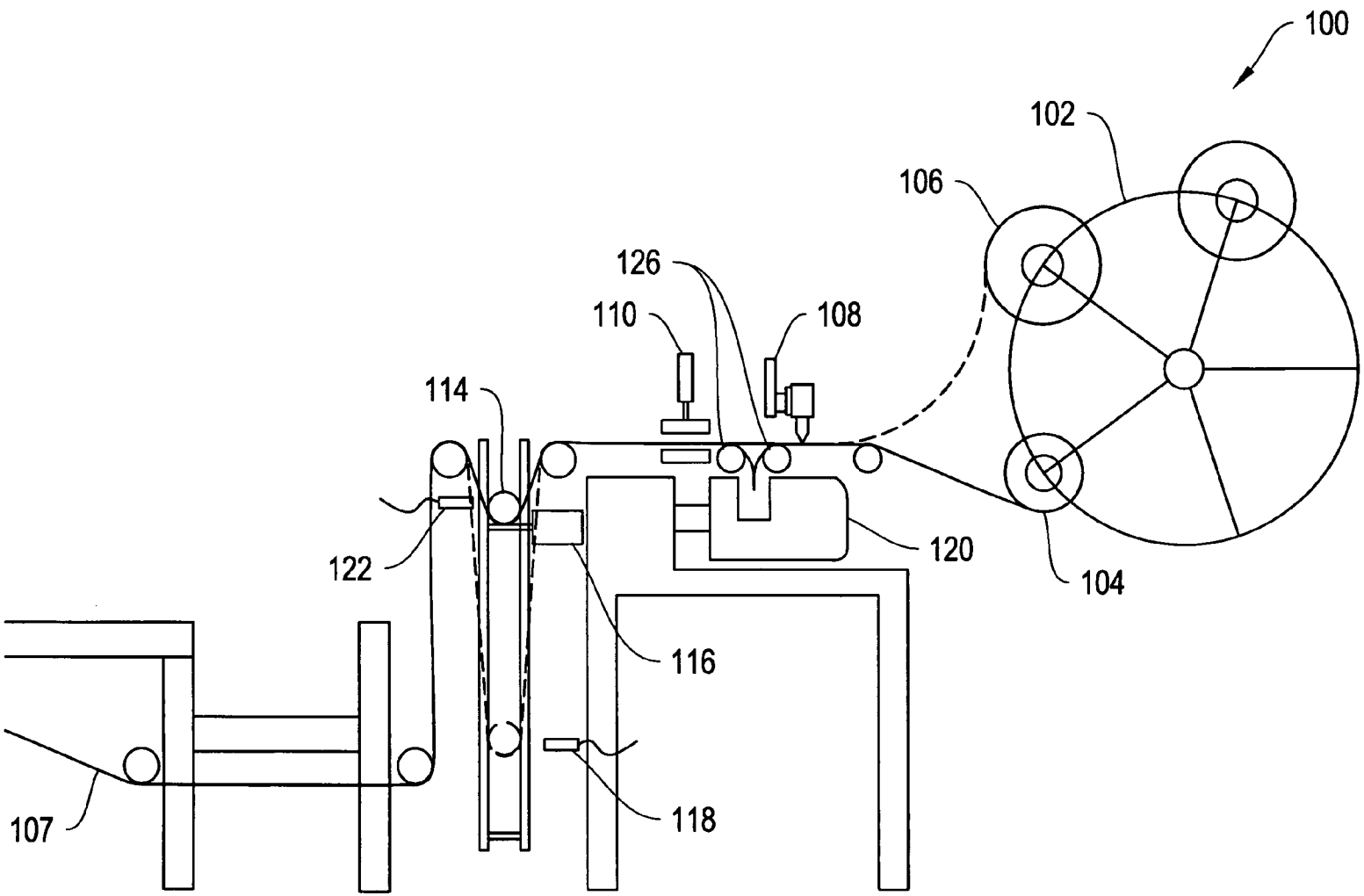
FIG. 5 depicts an alternative embodiment having moveable dancer rolls and a material carousel.

FIG. 5 depicts a further alternative embodiment of the quilting machine feeding system 100 that includes a carousel 102 carrying several roles of material for use by the system 100. In particular, FIG. 5 depicts a system 100 having a carousel 102 carrying rolls of material including the currently used roll 104 and at least one reserve roll 106. Material from the current roll 104 is drawn off as a web 107 that travels past a cutter 108, over a joiner 120, through a clamp 110 and into an accumulator having a dancer roller 114 and being similar to the accumulator described with reference to FIG. 4. In this embodiment at a prescribed time determined by the quilting machine, air cylinders 116 in the accumulator will retract allowing the weighted dancer roller (or bar) to drop between guide rails, pulling the web 107 off the current roll 104. When the dancer roller 114 is in the position indicated by a sensor 118, the clamp 110 engages the web 107. The cutter 108 then traverses the web 107 cutting the current roll 104 away from the web 107. The downstream material in the web 107 will be fed through the double rollers 126 positioned over the joiner 120. The operator will then take material from the reserve roll 106 and feed it through the double rollers 126 to the joiner 120. The joiner 120 will join the reserve roll 106 to the web 107 and complete the splice while the quilting machine draws in the excess fabric, raising the dancer roller 114 to its original position. A sensor 122 may detect when the dancer roller 114 is in the original position. If the dancer roller 114 completes this move prior to the completion of the joining operation the quilting machine may be paused. When the reserve roll 106 has been joined to the web 107, the carousel 102 can be locked and rotated so that a new roll is positioned to be joined with the web 107.

Those skilled in the art will know or be able to ascertain using no more than routine experimentation, many equivalents to the embodiments and practices described herein. Accordingly, it will be understood that the invention is not to be limited to the embodiments disclosed herein, but is to be understood from the following claims, which are to be interpreted as broadly as allowed under the law.

What is claimed is:

1. A quilting station, comprising a quilting machine having a feeder for drawing material into the machine, and a material dispensing unit having an active dispenser and a reserve dispenser, a plurality of rollers defining a path for a web of material to pass from the active dispenser to the quilting machine, a path extender disposed within the defined path and having a moveable surface for contacting the web passing along the defined path and for redirecting the web along an extended path to thereby create an in-path supply of the material, a joiner for joining material from the reserve dispenser to the web of material passing along the defined path, and a cutter located adjacent the joiner for cutting material from the active dispenser away from the web passing along the defined path.

2. A quilting station according to claim 1, further comprising a controller capable of controlling the movement of the web of material.

3. A quilting station according to claim 2, wherein the controller being programmed to control the path extender to create an in-path supply of material at a time selected to allow for continuous operation of the quilting machine.

4. A quilting station according to claim 3, wherein the controller is controlled by an operator or a batch processing program.

5. A quilting station according to claim 1, further comprising a brake coupled into the defined path and for securing the web to prevent motion of the web.

6. A quilting station according to claim 1, further comprising a ratchet disposed within the defined path and for preventing movement of the web in a particular direction.

7. A quilting station according to claim 1, wherein the joiner includes a bag sewer, or a glue machine.

8. A quilting station according to claim 1, having a supply table wherein an active dispenser and a reserve dispenser are formed on the supply table.

9. A quilting station according to claim 8, wherein the active dispenser comprises a curved surface with an optional set of rollers for supporting a roll of material to allow material to unroll for passing along the defined path.

10. A quilting station according to claim 8, wherein the reserve dispenser comprises a set of rollers for supporting a roll of material to allow material to unroll for passing along the defined path.

11. A quilting station according to claim 1, wherein the path extender includes a roller mounted on a moveable arm and disposed within the defined path for movement from a first position to a second position.

12. A quilting station according to claim 1, wherein the path extender includes a motorized arm carrying a roller at one end of the arm for positioning within the defined path of the web and being moveable from a first position to a second position.

13. A quilting station according to claim 1, wherein the path extender includes a weighted roller placed within the defined path, and a releasable latch for releasing the weighted roller to apply a force to the web of material for extending the defined path.

14. A material dispensing unit, comprising an active dispenser and a reserve dispenser, a plurality of rollers defining a path for a web of material to pass from either the active dispenser or the reserve dispenser and to a quilting machine, a path extender disposed within the defined path and having a moveable surface for contacting a web passing along the defined path and for redirecting the web along an extended path to thereby create an in-path supply of material, a joiner for joining material from the reserve dispenser to a web of material passing along the defined path, and a cutter located adjacent the joiner for cutting material from the active dispenser away from the web passing along the defined path.

15. The quilting station of claim 1, wherein the moveable surface redirects the web of material along the extended path at a rate greater than the rate of the feeder.

16. A method for fabricating quilts, the method comprising:

providing a quilting machine having a feeder for drawing material into the machine, providing a path for a web of material to pass from an active dispenser to the quilting machine, extending the path at a rate greater than a rate provided by the feeder by redirecting the web of material to create an in-path supply of material, and feeding the web of material along the path to the quilting machine.

17. The method of claim 16, wherein the path is defined by a plurality of rollers.

18. The method of claim 16, further comprising:

joining material from a reserve dispenser to the web of material passing along the path, and cutting material from the active dispenser away from the web of material passing along the path.

19. The method of claim 18, wherein a cutter for cutting material is located adjacent to a joiner for joining material.

20. The method of claim 16, wherein extending the path comprises disposing a path extender having a moveable surface for contacting the web of material passing along the path and for redirecting the web of material along the extended path to create the in-path supply of material.

21. The method of claim 16, further comprising providing a controller capable of controlling the movement of the web of material.

22. The method of claim 16, further comprising moving a roll of material from the active dispenser, and placing a roll of material from the reserve dispenser into the active dispenser.

* * * * *